US008864365B2

(12) United States Patent
Rodgers

(10) Patent No.: US 8,864,365 B2
(45) Date of Patent: Oct. 21, 2014

(54) CHEMICAL MIXER

(75) Inventor: Troy A. Rodgers, Chickasha, OK (US)

(73) Assignee: Rodgers Technology, LLC, Chickasha, OK (US)

( * ) Notice: Subject to any disclaimer, the term of this patent is extended or adjusted under 35 U.S.C. 154(b) by 875 days.

(21) Appl. No.: 12/868,224

(22) Filed: Aug. 25, 2010

(65) Prior Publication Data

US 2011/0203699 A1 Aug. 25, 2011

Related U.S. Application Data

(60) Provisional application No. 61/295,963, filed on Jan. 18, 2010, provisional application No. 61/236,629, filed on Aug. 25, 2009.

(51) Int. Cl.

| | |
|---|---|
| ***B01F 15/02*** | (2006.01) |
| ***B01F 15/00*** | (2006.01) |
| ***B01F 5/10*** | (2006.01) |
| ***B01F 5/00*** | (2006.01) |
| ***B01F 3/12*** | (2006.01) |
| ***B01F 13/00*** | (2006.01) |
| *B65B 1/04* | (2006.01) |
| *B01F 5/06* | (2006.01) |

(52) U.S. Cl.

CPC ... *B01F 3/12* (2013.01); *B01F 5/10* (2013.01); *B01F 5/0057* (2013.01); *B01F 15/0251* (2013.01); *B01F 13/0032* (2013.01); *B01F 13/0018* (2013.01)

USPC ..... 366/150.1; 366/152.1; 366/162.1; 366/171.1; 366/183.4; 366/176.2; 366/197; 141/368

(58) Field of Classification Search

None

See application file for complete search history.

(56) References Cited

U.S. PATENT DOCUMENTS

| | | | | |
|---|---|---|---|---|
| 3,822,056 | A * | 7/1974 | Hawes et al. | 366/114 |
| 4,494,345 | A * | 1/1985 | Peterson | 137/414 |
| 5,303,998 | A | 4/1994 | Whitlatch et al. | |
| 5,823,670 | A * | 10/1998 | Rushing et al. | 366/152.1 |
| 6,796,704 | B1 | 9/2004 | Lott | |
| 7,401,973 | B1 | 7/2008 | Lott | |
| 2003/0076737 | A1 * | 4/2003 | Grassi | 366/150.1 |

OTHER PUBLICATIONS

International Search Report and the Written Opinion (PCT/US2010/046651); May 20, 2011.

* cited by examiner

*Primary Examiner* — Neil N Turk

(74) *Attorney, Agent, or Firm* — Dunlap Codding, P.C.

(57) ABSTRACT

A chemical mixing apparatus has a mixing tank having an inlet and an outlet, means for introducing a liquid into the mixing tank, and a tubular conveyor assembly having a first end and a second end. The second end of the conveyor assembly is sealably connected to the inlet of the mixing tank. A portable hopper having a sealable inlet and a sealable discharge conduit is detachably and sealably connected to the first end of the conveyor assembly such that a solid chemical contained in the chemical storage chamber of the portable hopper may be transported within the portable hopper from a remote location and conveyed from the portable hopper to the mixing tank without exposing the area surrounding the mixing tank to the solid chemical.

14 Claims, 11 Drawing Sheets

CHEMICAL MIXER

CROSS REFERENCE TO RELATED APPLICATIONS

This application claims benefit to U.S. Provisional Application No. 61/295,963, filed Jan. 18, 2010, and U.S. Provisional Application No. 61/236,629, filed Aug. 25, 2009, the entire contents of each being hereby incorporated herein by reference.

BACKGROUND OF THE INVENTION

Caustic soda (sodium hydroxide, NaOH) and caustic potash (potassium hydroxide, KOH) are chemicals used to control the pH of water-based drilling fluids. Approximately 33,000 to 45,000 tons of these chemicals are used annually in the drilling fluids industry. Both are corrosive materials, handling of which causes injuries in the drilling industry each year. As used hereinafter the term "caustic" shall mean caustic soda, caustic potash, or a mixture of both chemicals. Before being added to the drilling fluid, dry caustic is dissolved in water at the drilling rig site. This process gives off a great deal of heat and results in a highly corrosive solution. Traditional methods of handling caustic at the drilling rig site involve the risk of exposure to dry caustic and concentrated caustic solutions resulting in severe burns and irritation to the skin, lung, and eyes.

Caustic used in drilling fluids is typically supplied to the rig in dry form (flakes or beads) in 40 lb or 50 lb sacks. While dry caustic is sometimes added directly to the drilling fluid system, more frequently it is dissolved in water at the rig site and added to the drilling fluid in liquid form to ensure that it is rapidly and evenly mixed throughout the entire drilling fluid system.

Several problems are encountered when dealing with sacks of caustic. First, empty sacks containing the dry powder residue are either improperly disposed of in land fills, or are incinerated. Next, back injuries result from lifting heavy sacks (40-50 lbs each) to pour in a mixing barrel. The mixing process requires a full protective hazmat suit, and all unprotected personnel must leave immediate area during this process. As a result of the wearing of the hazmat suit, the mobility and vision of personnel is limited. In addition, personnel turnover due to hazardous exposure is high. Finally, use of sacks can result in a lack of quality control in uniform mixing to fluid ratios.

To this end, a need exists for an improved caustic mixing apparatus and method which isolates personal at a work site from exposure to hazardous materials. It is to such an apparatus and method that the inventive concepts disclosed herein are directed.

BRIEF DESCRIPTION OF THE DRAWINGS

FIG. 6B is an enlarged view of circle 6B of FIG. 6A.

FIG. 9 is an exploded, perspective view of a conveyor assembly.

DETAILED DESCRIPTION OF EXEMPLARY EMBODIMENT

Figure 1:
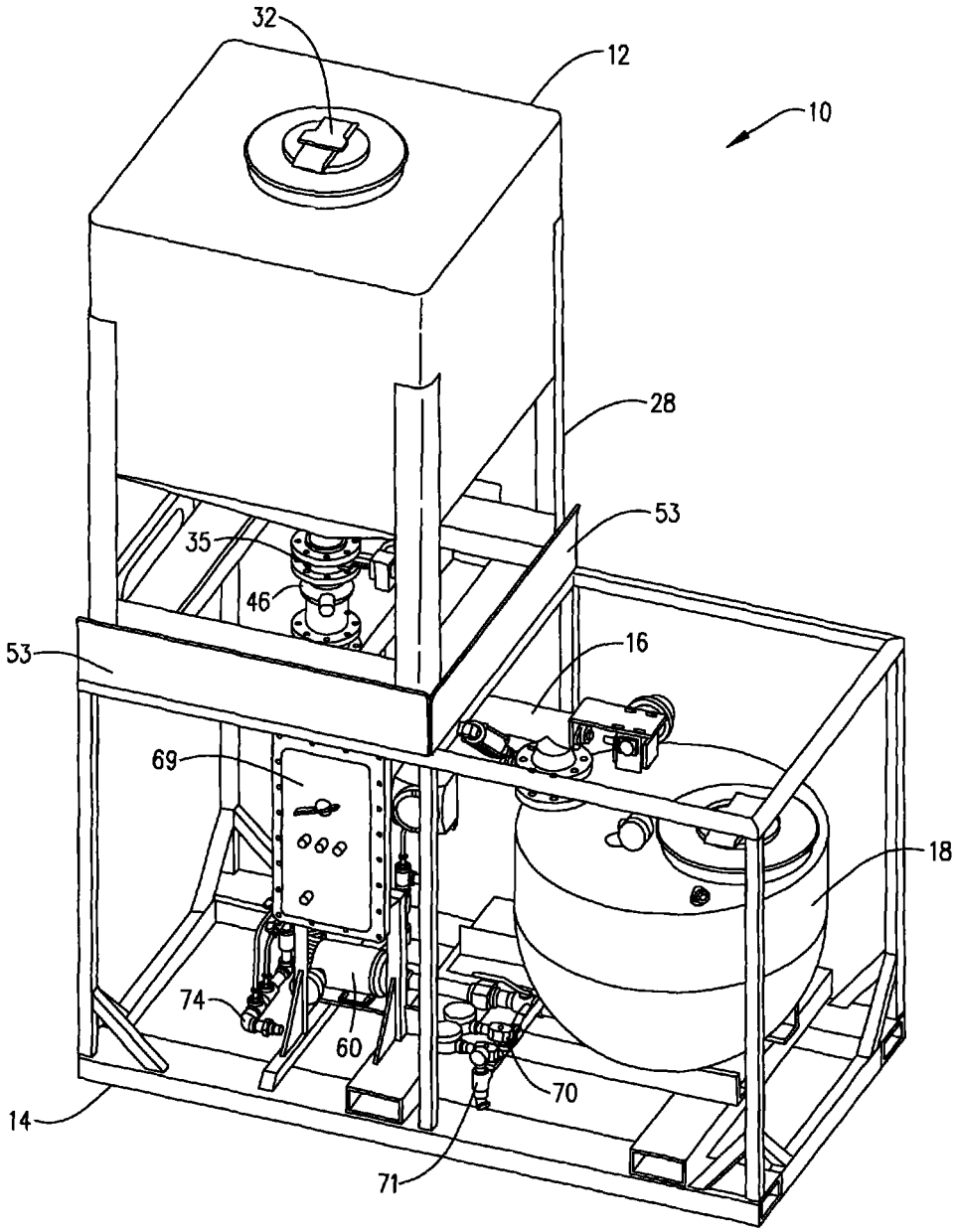
FIG. 1 is a perspective view of a mixing apparatus constructed in accordance with the inventive concepts disclosed herein.

Referring now to the drawings, and particularly to FIGS. 1-5, a chemical mixer 10 constructed in accordance with the inventive concepts disclosed herein is shown. Broadly, the chemical mixer 10 includes a portable hopper 12, a support skid 14, a conveyor assembly 16, and a mixing tank 18. In use, the mixing tank 18, the conveyor assembly 16, and the hopper 12 cooperate to form a sealed container so as to protect personnel from exposure to chemicals, such as caustic, during the transportation of the chemicals to a particular site, such as a drilling rig site and during the proves of mixing the chemicals with liquid to form a solution.

Figure 2:
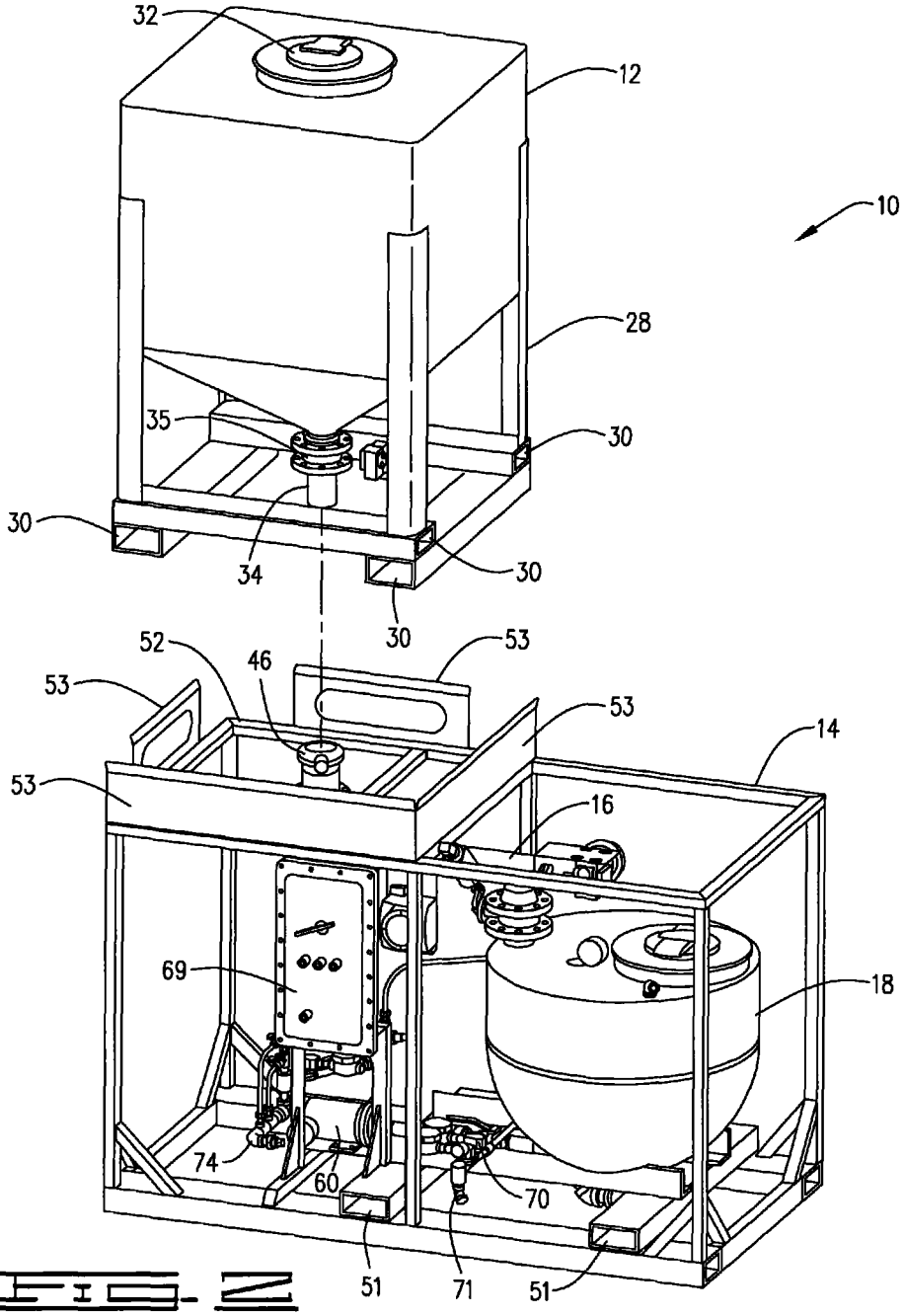
FIG. 2 is a perspective view of the mixing apparatus of FIG. 1 with a hopper shown in a detached condition.
Figure 3:
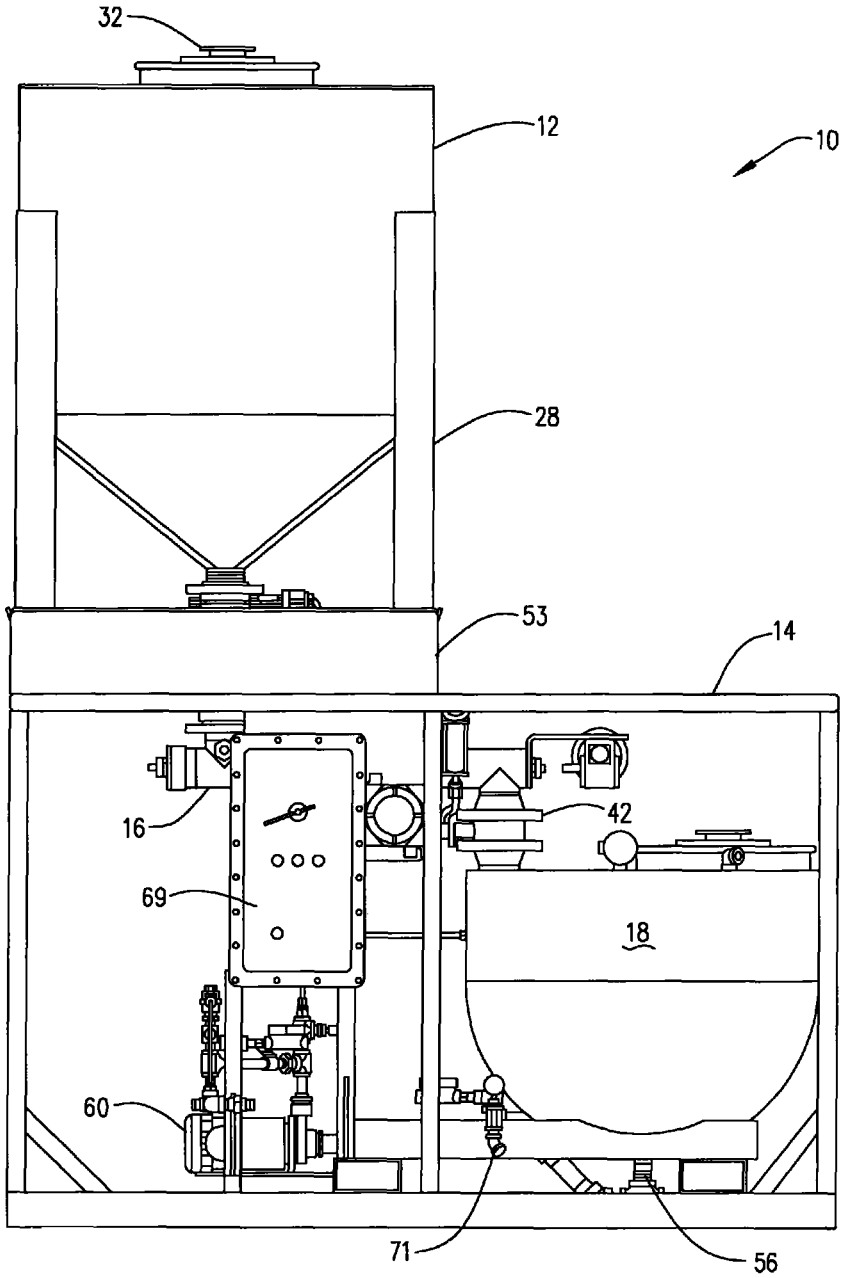
FIG. 3 is a front elevational view of the mixing apparatus of FIG. 1.

The hopper 12 is preferably a reusable, stainless steel transport container defining a chemical storage chamber. The hopper 12 can be selectively connected and disconnected from the conveyor assembly 16 (FIGS. 1-2). The hopper 12 is provided with a frame assembly 28 (FIG. 2) and two sets of fork receptacles 30 (FIG. 2) to permit the hopper 12 to be positioned on and removed from the skid 14, via a fork lift, thereby eliminating back injuries related to the caustic mixing process. The two sets of fork receptacles 30 are preferably open on both ends and are oriented at 90° relative to each other to allow the hopper 12 to be lifted from any one of its four sides. The hopper 12 includes a sealable inlet 32 and a sealable lower discharge conduit 34 which may be sealed with a valve, such as a gate valve 35 (FIGS. 2 and 6B). The hopper 12 may be any size and shape, but to facilitate transport, the hopper 12 preferably has a square shaped footprint.

FIG. 9 shows the conveyor assembly 16 including a tubular body 38 with a first end 40 sealably connectable to the lower discharge conduit 34 of the hopper 12, a second end 42 sealably attached to the mixing tank 18. The tubular body 38 supports an auger 44.

Figure 6A:
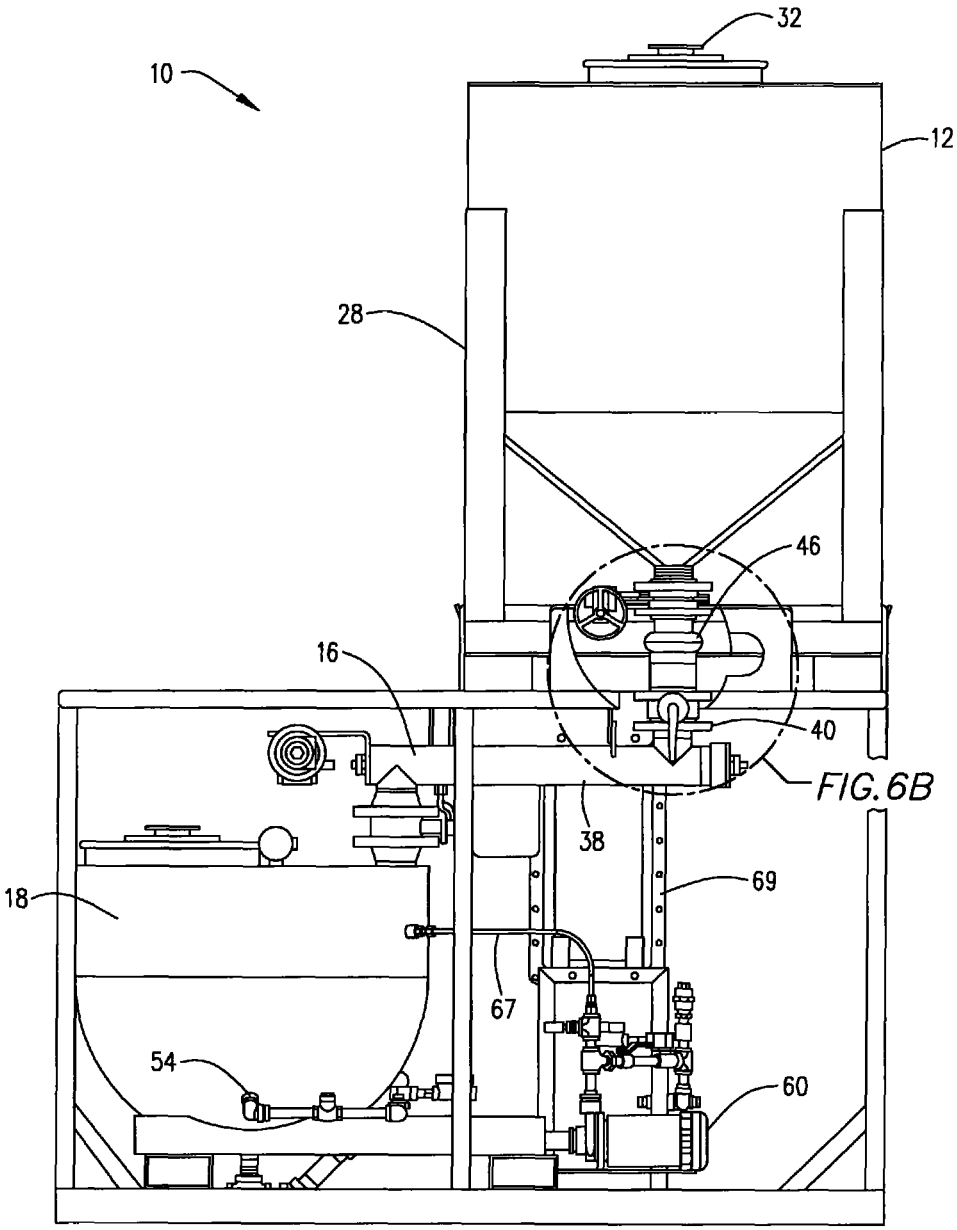
FIG. 6A is a partially cutaway, rear elevational view of the mixing apparatus of FIG. 1.
Figure 5B:
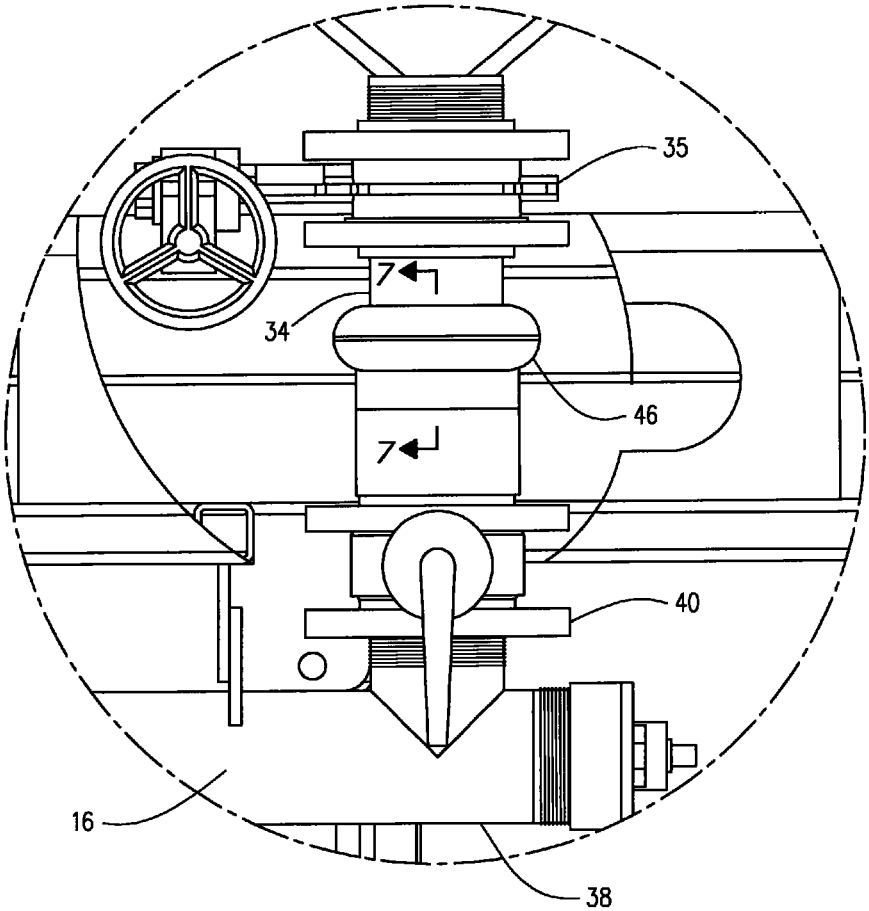
Figure 7:
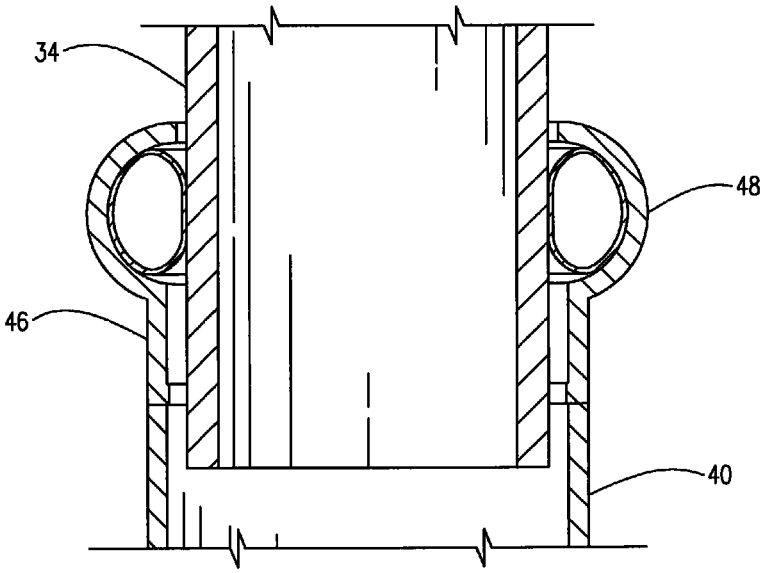
FIG. 7 is a cross section taken along line 7-7 of FIG. 6B.
Figure 8:
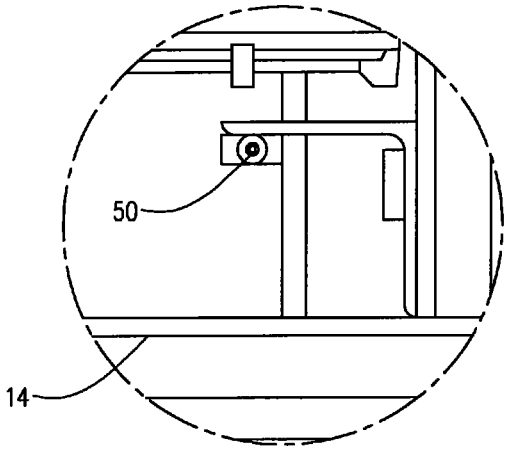
FIG. 8A is a top plan view of the mixing apparatus of FIG. 1 with the hopper removed.
FIG. 8B is an enlarged view of circle 8B of circle 8B of FIG. 8A.
Figure 8A:
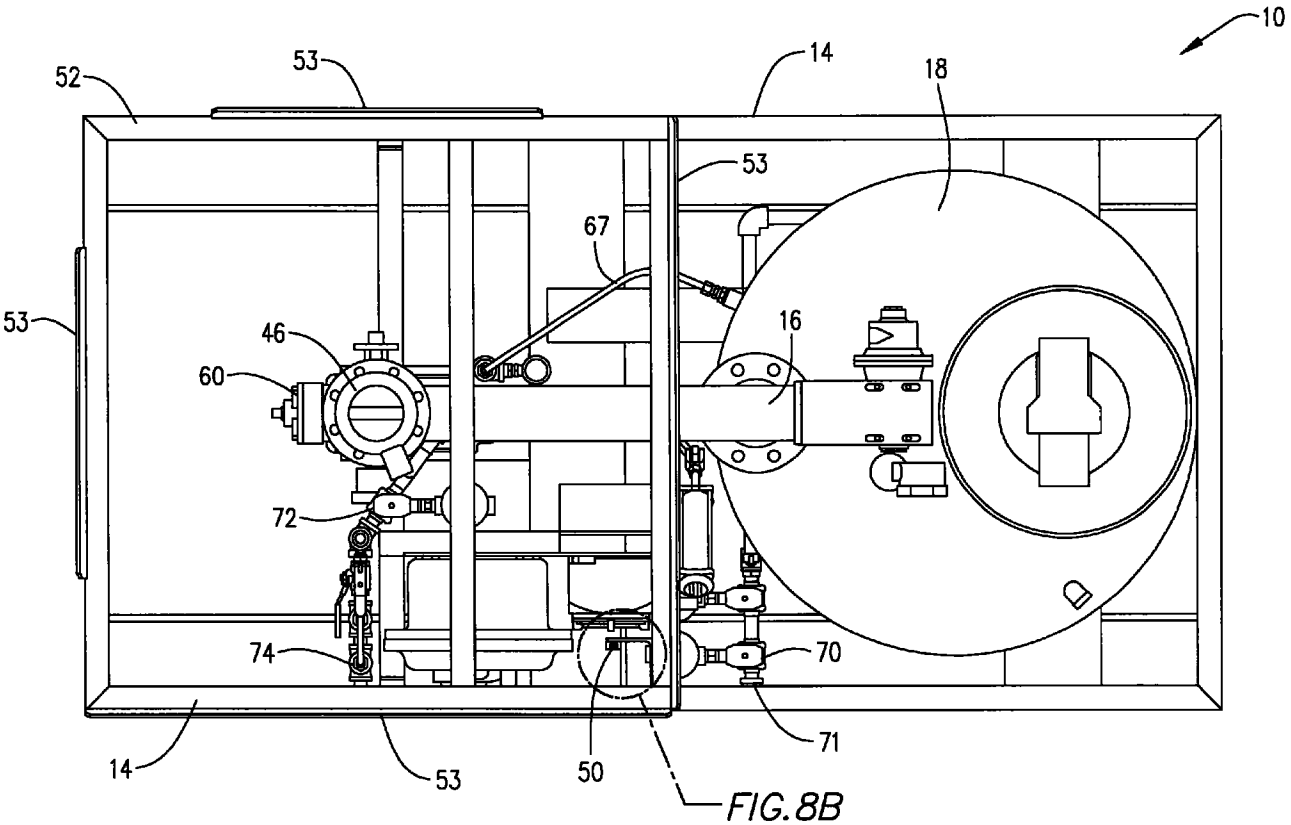
Figure 5:
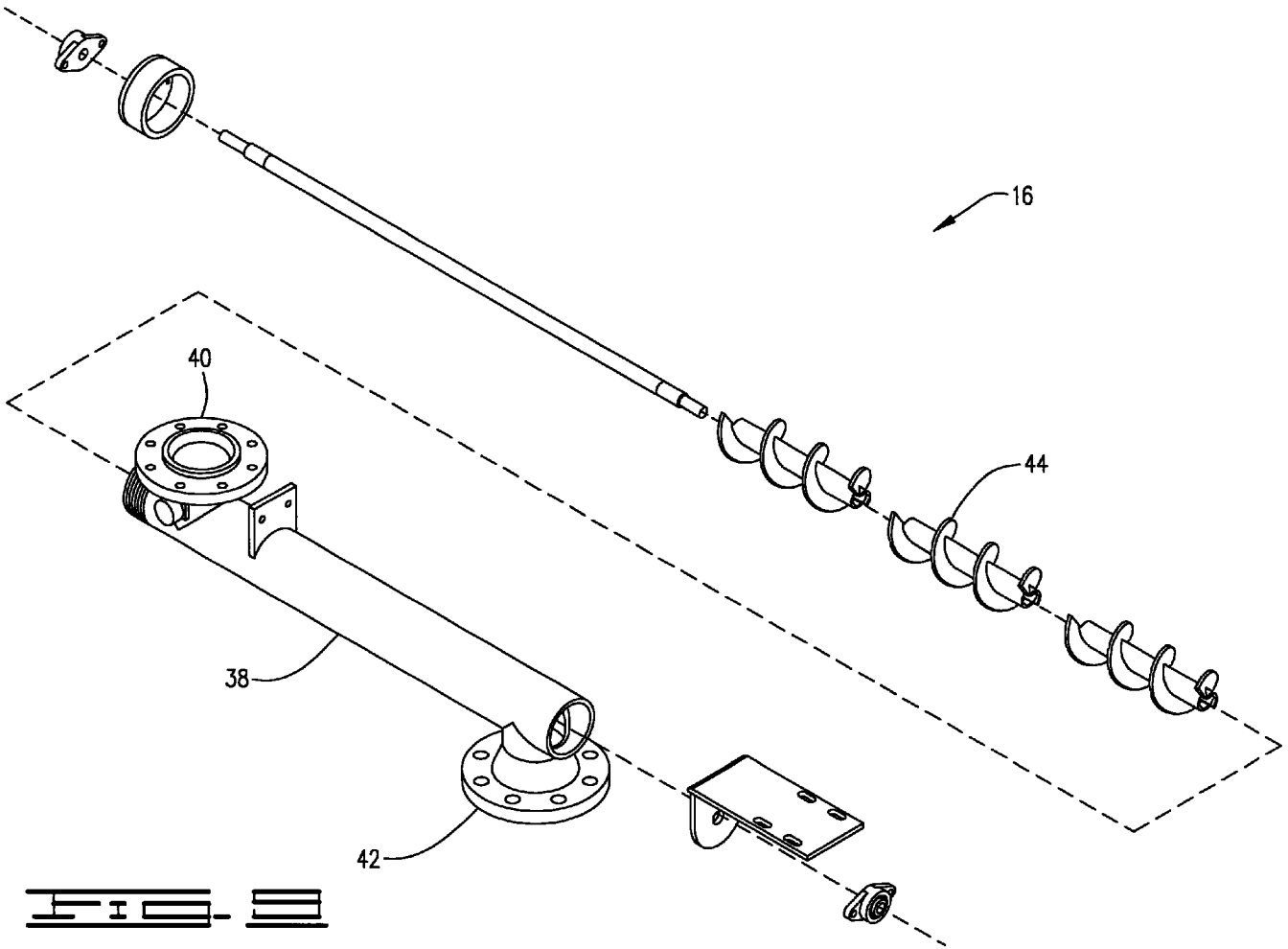

As best shown in FIGS. 6A, 6B, and 7, the first end 40 of the tubular body 38 is provided with a seal assembly 46. In one embodiment, the seal assembly 46 is an air bladder seal 48 (FIG. 7) which is positionable between a retracted and an expanded position such that the lower discharge conduit 34 may be freely inserted into the conveyor assembly 46 when the bladder seal 48 is in the retracted position and a seal is formed around the discharge conduit 34 when the air bladder seal 48 is in the expanded position (FIG. 7). The air bladder seal 48 may be selectively activated via a switch 50 (FIG. 8B) mounted on the skid 14. The switch 50 is activated when the hopper 12 is placed upon the skid 14 with the discharge conduit 34 positioned in the air bladder seal 48. It will be appreciated that the air bladder seal 48 is connected to a suitable pressurized air source (not shown).

The support skid 14 supports the mixing tank 18 and the conveyor assembly 36 (FIGS. 1-5 and 8A). The support skid 14 further provides a platform 52 (FIG. 5) for supporting the hopper 12 in a position above the conveyor assembly 16. The platform 52 includes a plurality of vertical guide members 53 to guide the hopper 12 as it is being inserted into the seal assembly 46 of the conveyor assembly 16 (FIGS. 1-5). To facilitate moving the chemical mixer 10, the skid 14 may be provided with fork receptacles 51.

Figure 10:
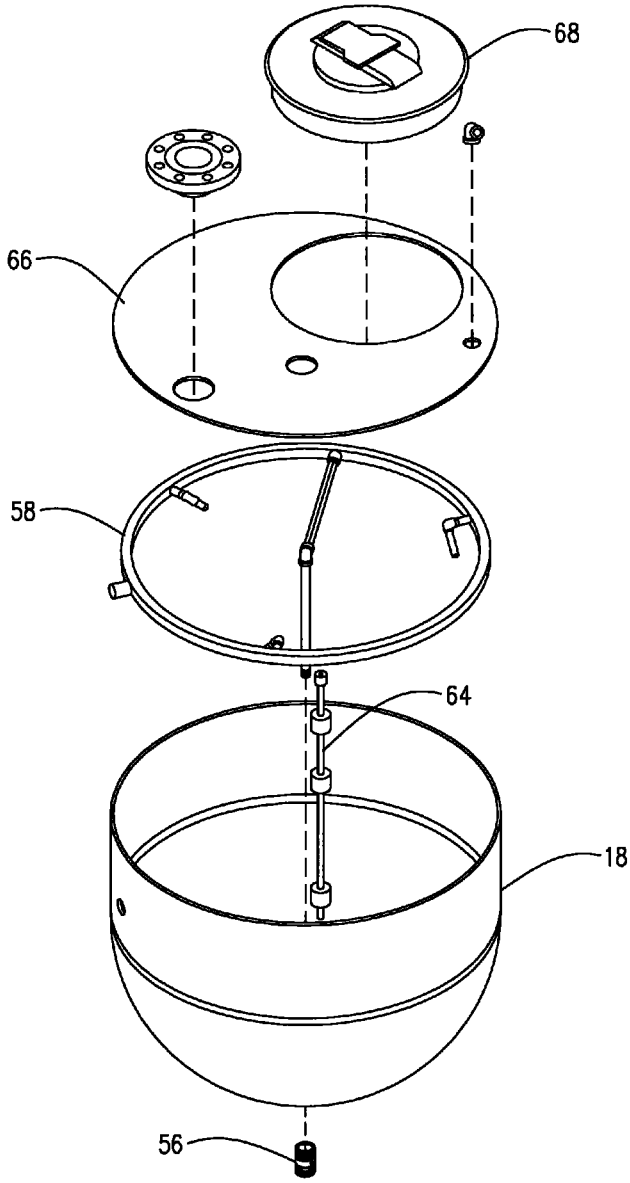
FIG. 10 is an exploded, perspective view of a mixing tank.

Referring now to FIG. 10, the mixing tank 18 has an inlet 54 (FIG. 6A) and an outlet 56. The mixing tank 18 further includes a nozzle assembly 58 through which liquid is reintroduced into the mixing tank 18 by a pump 60 (FIG. 6A) to create a vortical motion inside the mixing tank 18 for mixing caustic with a liquid, such as water. The mixing tank 18 is shown to also include a liquid level sensor 64 for use in controlling operation of the chemical mixer 10 in a manner to be described below. The mixing tank 18 has a top 66 and removable lid 68 to permit access to the mixing tank 18.

The chemical mixer 10 is preferably automated to better ensure quality control through even delivery of caustic chemical to water. This results in lower costs due to appropriate level of chemical and ensures the well is not negatively impacted. To this end, conventional control systems such as a control assembly 69 may be utilized to synchronize the operation of the various components of the chemical mixer 10.

Figure 4:
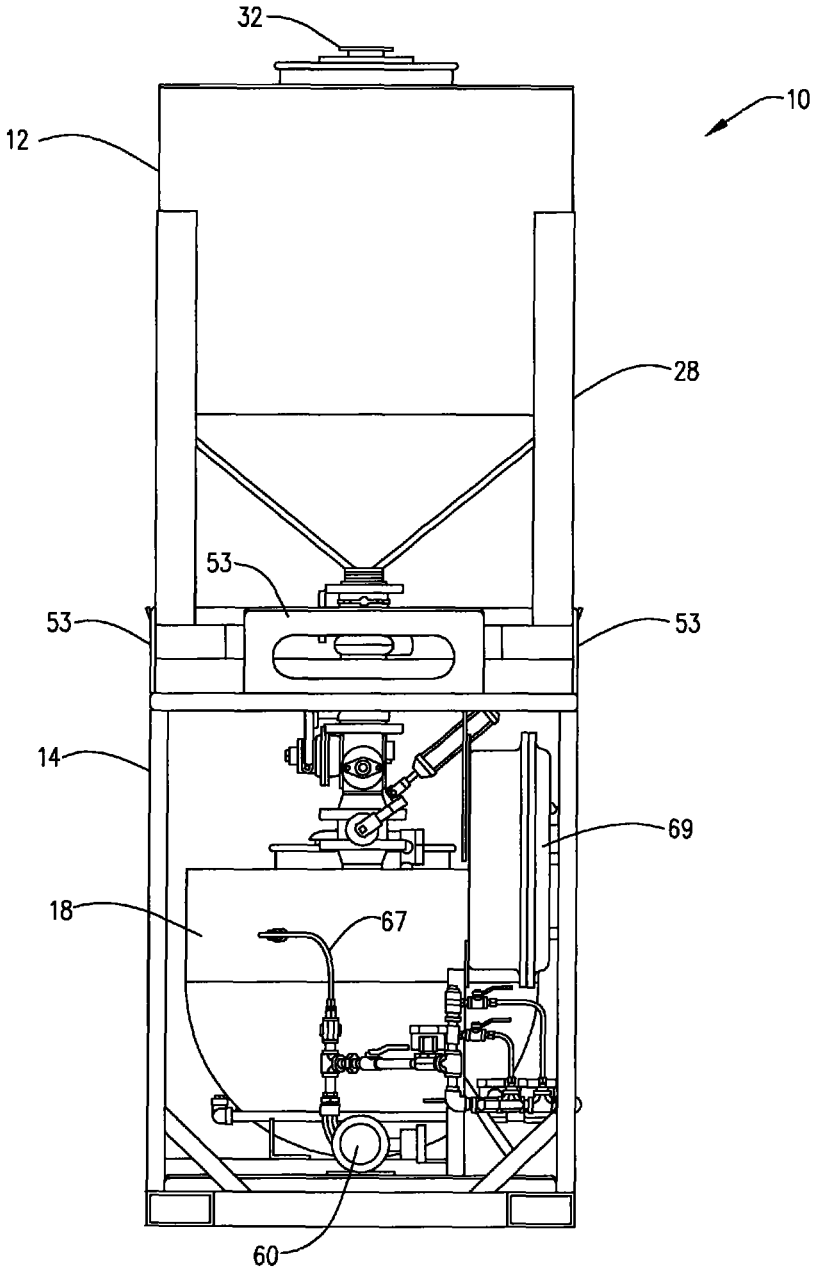
FIG. 4 is a left elevational view of the mixing apparatus of FIG. 1.
Figure 5:
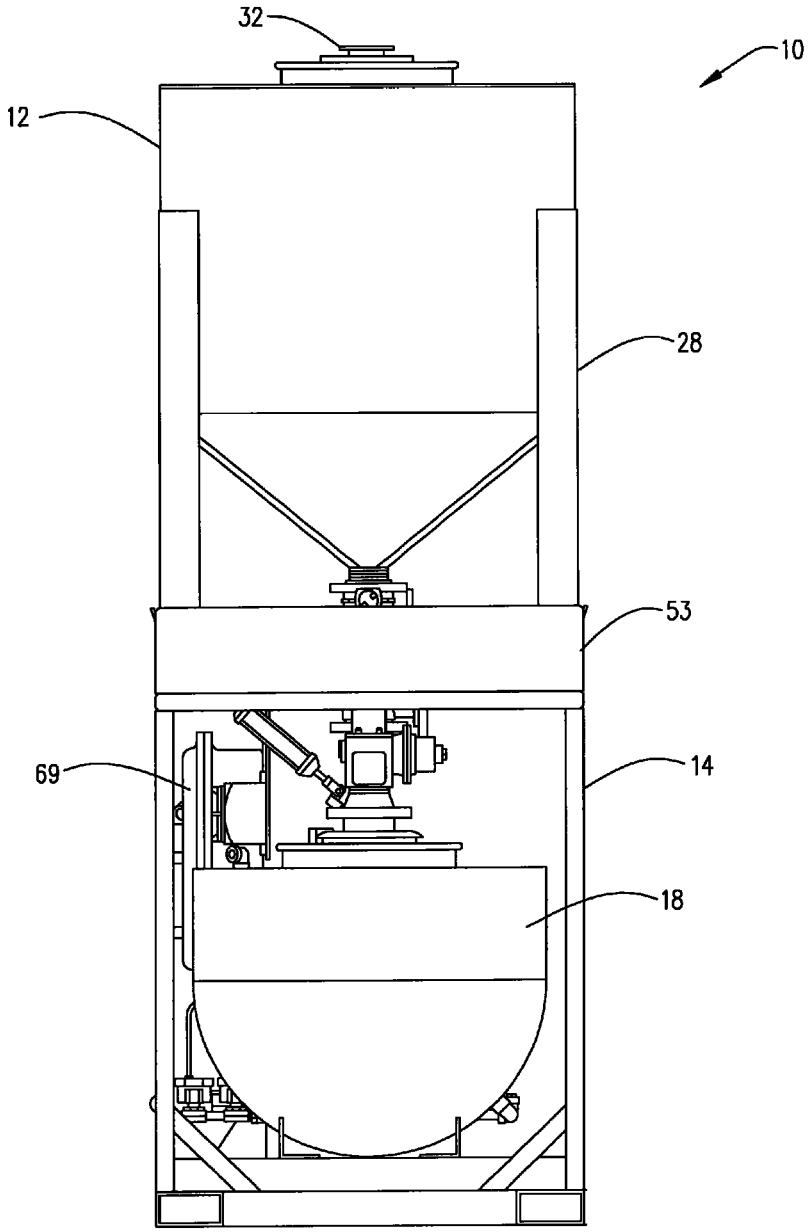
FIG. 5 is a right elevational view of the mixing apparatus of FIG. 1.

In use, the hopper 12 is filled with caustic at a remote, sealed location, and transported to the drilling rig site. At the drilling rig site, the hopper 12 is positioned on the platform 52 of the skid 14 such that the discharge conduit 34 is positioned in the first end 40 of the conveyor assembly 16 and connected to the conveyor assembly 16. A cycle is started by activating control assembly 69. A liquid fill valve 70 is caused to open and liquid is introduced into the mixing tank 18 via a conduit 71. The pump 60 starts withdrawing and reintroducing liquid into the mixing tank through the nozzle assembly 58 via a conduit 67 (FIGS. 4 and 10). Once a desired liquid level is achieved inside the mixing tank 18 as determined by a high liquid control switch of the liquid level sensor 64, the conveyor assembly 16 is activated so as to cause caustic to be transported into the mixing tank 18 at desired volumes. A discharge valve 72 is opened to discharge mixed caustic via a conduit 74 to mud tanks at desired rate (vary by application at well). A low liquid control switch of the liquid level sensor 64 shuts off the pump 60 when the mixing tank 18 is empty, which defines a single cycle or application.

The mixing tank 18 may be of any size and dimension, but preferably is sized to accommodate an 8,000 foot well under normal application. Also, while the chemical mixer 10 has been described for use in the oil and gas industry, it should be appreciated that the chemical mixer may have application in other industries where there is a desire to eliminate the handling of reactive chemicals/fumes/gases or air containments which can irritate the human body. It should also be appreciated that the components of the chemical mixer 10 may be modified as to minimize explosion and/or fire safety risks as required by applicable industry safety standards. Such modifications may vary depending on the specific safety standards at a particular drilling rig site.

From the above description, it is clear that the inventive concepts expressed herein are well adapted to carry out the objects and to attain the advantages mentioned herein as well as those inherent in the inventive concepts expressed herein. While presently preferred embodiments of the inventive concepts disclosed herein have been described for purposes of this disclosure, it will be understood that numerous changes may be made which will readily suggest themselves to those skilled in the art and which are accomplished within the spirit of the inventive concepts disclosed and as defined in the appended claims.

What is claimed is:

1. An apparatus, comprising:

a portable support skid, the support skid having a platform;

a mixing tank having an inlet and an outlet, the mixing tank mounted to the support skid;

means for introducing a liquid into the mixing tank;

a tubular conveyor assembly having a first end and a second end, the tubular conveyor assembly supported by the support skid with the second end sealably connected to the inlet of the mixing tank and the first end laterally offset from the second end, the conveyor assembly including a tubular body housing an auger extending from the first end to the second end of the conveyor assembly; and a portable hopper defining a chemical storage chamber and having a sealable inlet and a sealable discharge conduit, the portable hopper supported by the platform of the support skid with the discharge conduit being detachably and sealably connected to the first end of the conveyor assembly such that a solid chemical contained in the chemical storage chamber of the portable hopper may be transported within the portable hopper from a remote location and conveyed from the portable hopper to the mixing tank without exposing the area surrounding the mixing tank to the solid chemical, wherein the first end of the conveyor assembly has a seal assembly that seals about the discharge conduit automatically upon the portable hopper being positioned on the platform of the skid, wherein the seal assembly comprises:

an air bladder positionable between a retracted condition wherein the discharge conduit may pass to and from the first end of the conveyor assembly and an expanded condition wherein the air bladder forms a seal about the discharge conduit; and a switch operably connected to the air bladder, the switch supported by the support skid in such a way that upon positioning the portable hopper on the platform of the support skid, the portable hopper contacts the switch thereby causing the air bladder to be positioned in the expanded condition.

2. The apparatus of claim 1 wherein the portable hopper has at least one pair of fork receptacles for receiving the forks of a forklift.

3. The apparatus of claim 1 wherein the portable hopper has at least two pairs of fork receptacles with one pair of fork receptacles being oriented at a 90 degree angle relative to the other pair of fork receptacles, and wherein each pair of the fork receptacles straddles the discharge conduit of the portable hopper.

4. The apparatus of claim 1 wherein the portable hopper has a square-shaped footprint.

5. The apparatus of claim 1 wherein the support skid has a plurality of vertical guide members surrounding the support platform to guide the discharge conduit of the portable hopper into the first end of the conveyor assembly when positioning the portable hopper on the platform.

6. The apparatus of claim 1 further comprising means for circulating the liquid in the mixing tank, the means for circulating the liquid including a nozzle assembly positioned in the mixing tank such that liquid is reintroduced into the mixing tank so as to create a vortex.

7. The apparatus of claim 6 wherein the means for circulating the liquid into the mixing tank includes a pump and wherein the pump is in fluid communication with the nozzle assembly and wherein the pump is in fluid communication with the outlet of the mixing tank.

8. An apparatus for mixing a caustic solution, comprising:

a portable support skid, the support skid having a platform;

a mixing tank having an inlet and an outlet, the mixing tank mounted to the support skid;

means for introducing a liquid into the mixing tank;

a tubular conveyor assembly having a first end and a second end, the tubular conveyor assembly supported by the support skid with the second end sealably connected to the inlet of the mixing tank and the first end laterally offset from the second end, the conveyor assembly including a tubular body housing an auger extending from the first end to the second end of the conveyor assembly; and a quantity of solid caustic disposed in a portable hopper having a sealed inlet and a sealed discharge conduit, the portable hopper supported by the platform of the support skid with the discharge conduit being detachably and sealably connected to the first end of the conveyor assembly such that the caustic disposed in the portable hopper may be transported within the portable hopper from a remote location and conveyed from the portable hopper to the mixing tank without exposing the area surrounding the mixing tank to the caustic, wherein the first end of the conveyor assembly has a seal assembly that seals about the discharge conduit automatically upon the portable hopper being positioned on the platform of the skid, wherein the seal assembly comprises:

an air bladder positionable between a retracted condition wherein the discharge conduit may pass to and from the first end of the conveyor assembly and an expanded condition wherein the air bladder forms a seal about the discharge conduit; and a switch operably connected to the air bladder, the switch supported by the support skid in such a way that upon positioning the portable hopper on the platform of the support skid, the portable hopper contacts the switch thereby causing the air bladder to be positioned in the expanded condition.

9. The apparatus of claim 8 wherein the portable hopper has at least one pair of fork receptacles for receiving the forks of a forklift.

10. The apparatus of claim 8 wherein the portable hopper has at least two pair of fork receptacles with one pair of fork receptacles being oriented at a 90 degree angle relative to the other pair of fork receptacles, and wherein each pair of the fork receptacles straddles the discharge conduit of the portable hopper.

11. The apparatus of claim 8 wherein the portable hopper has a square-shaped footprint.

12. The apparatus of claim 8 wherein the support skid has a plurality of vertical guide members surrounding the support platform to guide the discharge conduit of the portable hopper into the first end of the conveyor assembly when positioning the portable hopper on the platform.

13. The apparatus of claim 8 wherein the means for introducing the liquid into the mixing tank includes a nozzle assembly positioned in the mixing tank such that liquid is reintroduced into the mixing tank so as to create a vortex.

14. The apparatus of claim 13 wherein the means for reintroducing the liquid into the mixing tank includes a pump and wherein the pump is in fluid communication with the nozzle assembly and wherein the pump is in fluid communication with the outlet of the mixing tank.

* * * * *